US009512747B2

(12) United States Patent
Kim

(10) Patent No.: US 9,512,747 B2
(45) Date of Patent: Dec. 6, 2016

(54) VALVE TRAIN LAYOUT STRUCTURE INCLUDING CAM PHASER AND CAMSHAFT-IN-CAMSHAFT

(71) Applicant: Hyundai Motor Company, Seoul (KR)

(72) Inventor: Hyoung Hyoun Kim, Hwaseong-si (KR)

(73) Assignee: Hyundai Motor Company, Seoul (KR)

( * ) Notice: Subject to any disclaimer, the term of this patent is extended or adjusted under 35 U.S.C. 154(b) by 31 days.

(21) Appl. No.: 14/448,603

(22) Filed: Jul. 31, 2014

(65) Prior Publication Data

US 2015/0176440 A1 Jun. 25, 2015

(30) Foreign Application Priority Data

Dec. 20, 2013 (KR) ..... 10-2013-0160723

(51) Int. Cl.

| | |
|---|---|
| ***F01L 1/34*** | (2006.01) |
| ***F01L 1/344*** | (2006.01) |
| *F01L 1/02* | (2006.01) |
| *F01L 1/053* | (2006.01) |

(52) U.S. Cl.

CPC ..... *F01L 1/344* (2013.01); *F01L 1/3442* (2013.01); *F01L 1/026* (2013.01); *F01L 2001/0537* (2013.01); *F01L 2001/34486* (2013.01)

(58) Field of Classification Search

CPC ..... F01L 1/026; F01L 1/344; F01L 1/3442; F01L 2001/0537; F01L 2001/34486

USPC ..... 123/90.15, 90.17, 90.27, 90.31

See application file for complete search history.

(56) References Cited

U.S. PATENT DOCUMENTS 7,273,024 B2 * 9/2007 Lancefield ..... F01L 1/024 123/90.15

2010/0212618 A1 * 8/2010 Murata

FOREIGN PATENT DOCUMENTS

| | | | |
|---|---|---|---|
| JP | 3329933 | B2 | 7/2001 |
| JP | 4873193 | B2 | 12/2011 |
| KR | 1997-0027649 | A | 6/1997 |
| KR | 10-1063723 | B1 | 9/2011 |
| KR | 10-1222229 | B1 | 1/2013 |

* cited by examiner

*Primary Examiner* — Ching Chang

(74) *Attorney, Agent, or Firm* — Morgan, Lewis & Bockius LLP

(57) ABSTRACT

A valve train layout structure may comprise a non-control camshaft connected to a chain sprocket rotating in line with engine timing and adapted not to vary opening/closing timing of a valve, a control camshaft including an outer shaft, a first cam fixed to an outer shaft, an inner shaft rotatably inserted in an outer shaft, and a second cam fixed to an inner shaft and adapted to vary opening/closing timing of at least one of a valve activated by a first cam and a valve activated by a second cam by varying a phase between a first cam and a second cam, and a cam phaser including a rotor and a stator rotatable relatively to each other. One of a rotor and a stator may be operatively connected to the outer shaft and the other of a rotor and a stator is operatively connected to the inner shaft such that the cam phaser can vary the phase between the first cam and the second cam.

16 Claims, 6 Drawing Sheets

VALVE TRAIN LAYOUT STRUCTURE INCLUDING CAM PHASER AND CAMSHAFT-IN-CAMSHAFT

CROSS-REFERENCE TO RELATED APPLICATION

The present application claims priority of Korean Patent Application Number 10-2013-0160723 filed on Dec. 20, 2013, the entire contents of which application are incorporated herein for all purposes by this reference.

BACKGROUND OF INVENTION

1. Field of Invention

The present invention relates to a valve train layout structure, and more particularly, to a valve train layout structure including a cam phaser and a camshaft-in-camshaft.

2. Description of Related Art

Internal combustion engine generates power by sucking fuels and air into a combustion chamber and combusting them. An intake valve is opened by a driving camshaft and while the intake valve is opened, the air or mixture of fuel and air is sucked into the combustion chamber. Further, an exhaust valve is opened by the driving camshaft after combustion and while the exhaust valve is opened, combustion gas is discharged out of the combustion chamber.

Optimum operation of an intake valve and an exhaust valve is adjusted depending on rotating speed of an engine. This is because adequate valve lift or opening/closing timing of a valve varies depending on the engine rotation speed. Like this, the way of varying the opening/closing timing of an intake valve or an exhaust valve in accordance respectively with low speed or high speed of an engine in order to supplement the drawbacks of the general engine is called variable valve timing (VVT) method.

Unlike a prior camshaft, a camshaft-in-camshaft is not comprised of a shaft but a hollow camshaft, namely an outer shaft and a different shaft rotatably inserted therein, namely an inner shaft.

There are two kinds of cam lobes of a camshaft-in-camshaft, one kind of which are first cams fixedly installed on the outer shaft and the other kind of which are second cam fixed to the inner shaft and rotatable on the outer shaft.

A camshaft-in-camshaft structure has been devised such that among two types of valve connected thereto, one type of valve is moved unvariably in line with engine timing without special control and the movement of the other type of valve is controlled in order for a phase of the valve to become different from that of the former type of valve. A control apparatus varying a phase between a first cam and a second cam is called a cam phaser.

By utilize the camshaft-in-camshaft and the cam phaser, continuous variable valve timing (CVVT) method can be realized. The camshaft-in-camshaft a phase of which between a first cam and a second cam is varied by the cam phaser is generally called a control camshaft.

Generally, the control camshaft is fitted directly with the cam phaser such that the cam phaser can advance or delay (hereinafter, vary) a phase angle and, in other words, vary opening/closing timing of an intake valve or an exhaust valve. However, due to a layout structure in case of an engine's being actually mounted in a vehicle, a problem can happen in which the control camshaft can't be fitted directly with the cam phaser.

To overcome this problem, substantial changes in parts restricting the layout structure may be needed, but, they are very big task of changing not only the design of an engine but also entire package of the vehicle and come close to new development of an engine. In case of a remodeled engine, it's the case that to cope with the problem is almost impossible. Accordingly, a change in a structure and an installation position or an installation method of the cam phaser is required.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention are directed to providing a variety of valve train layout structures realized without substantial change in package system of an engine or a vehicle.

In various aspects of the present invention, a valve train layout structure may comprise a non-control camshaft connected to a chain sprocket rotating in line with engine timing and adapted not to vary opening/closing timing of a valve, a control camshaft including an outer shaft, a first cam fixed to the outer shaft, an inner shaft rotatably inserted in the outer shaft, and a second cam fixed to the inner shaft and the control camshaft adapted to vary opening/closing timing of at least one of a valve activated by the first cam and a valve activated by the second cam by varying a phase between the first cam and the second cam, and a cam phaser including a rotor and a stator rotatable relatively to each other. One of the rotor and the stator may be operatively connected to the outer shaft and the other of the rotor and the stator is operatively connected to the inner shaft such that the cam phaser can vary the phase between the first cam and the second cam.

In an aspect, the rotor may be driven in line with the engine timing and the stator may be rotatable relatively to the rotor. In another aspect, the stator may be driven in line with the engine timing and the rotor may be rotatable relatively to the stator.

One side portion of the outer shaft may be fitted with a first driven gear and one side portion of the inner shaft may be fitted with a second driven gear. The rotor may be fitted with a first driving gear engaging with one of the first driven gear and the second driven gear, and the stator may be fitted with a second driving gear engaging with the other of the first driven gear and the second driven gear.

One of the rotor and the stator, which is driven in line with the engine timing, may be fixedly connected with the chain sprocket, the first driving gear may engage with the second driven gear, and the second driving gear may engage with the first driven gear.

One of the rotor and the stator, which is driven in line with the engine timing, may be fixedly connected with the chain sprocket, the first driving gear may engage with the first driven gear, and the second driving gear may engage with the second driven gear.

In various aspects of the present invention, one side portion of the non-control camshaft may be fitted with the chain sprocket and a first driving gear, and the opposite end of the non-control camshaft may be fitted with the cam phaser equipped with a second driving gear. And, one of the inner shaft and the outer shaft may be fitted with a first driven gear engaging with the first driving gear and the other of the inner shaft and the outer shaft may be fitted with a second driven gear engaging with the second driving gear.

The first driven gear may be mounted on one side portion of the inner shaft and the second driven gear may be mounted on the other side portion of the outer shaft. The second driven gear may be mounted on one side portion of the inner shaft and the first driven gear may be mounted on the other side portion of the outer shaft.

In various aspects of the present invention, one side portion of the non-control camshaft may be fitted with the chain sprocket and a first driving gear, the opposite end of the control camshaft may be fitted with the cam phaser, the rotor of the cam phaser may be connected with the inner shaft, and the stator of the cam phaser may be connected with the outer shaft. And, the first driving gear may engage with a first driven gear mounted on one side portion of the inner shaft.

In various aspects of the present invention, one side portion of the non-control camshaft may be fitted with the cain sprocket and a first driving gear, the opposite end of the control camshaft may be fitted with the cam phaser, the rotor of the cam phaser may be connected with the inner shaft, and the stator of the cam phaser may be connected with the outer shaft. And, the first driving gear may engage with a first driven gear mounted on one side portion of the outer shaft.

The methods and apparatuses of the present invention have other features and advantages which will be apparent from or are set forth in more detail in the accompanying drawings, which are incorporated herein, and the following Detailed Description, which together serve to explain certain principles of the present invention.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
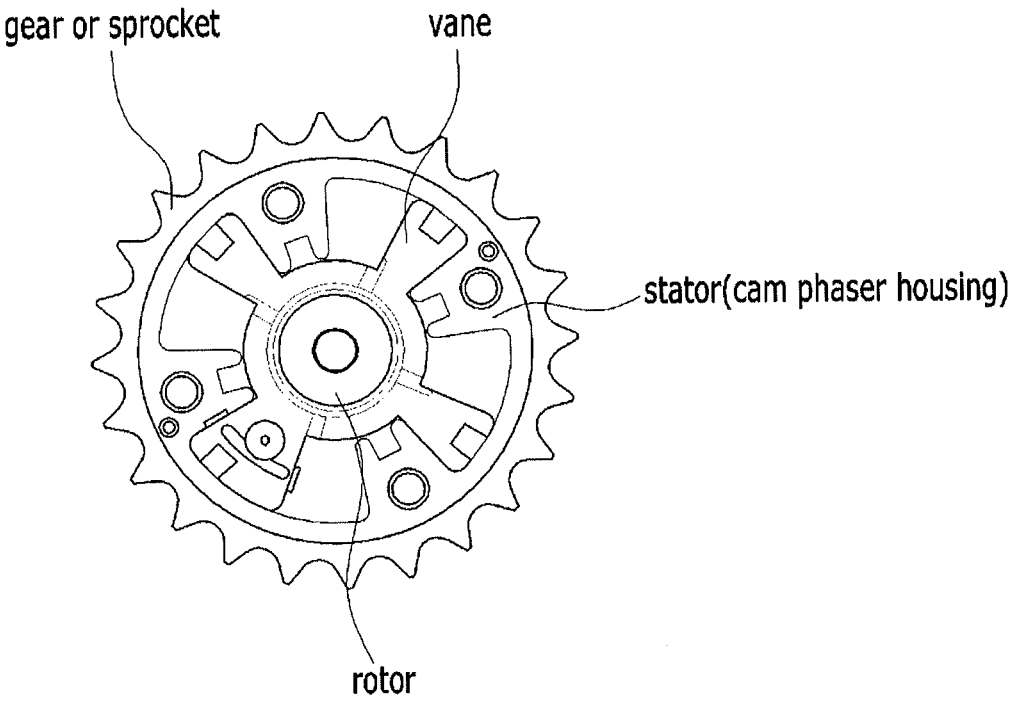
FIG. 1 is a schematic diagram of cam phaser.

It should be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In addition, unless explicitly described to the contrary, the word "comprise" and variations such as "comprises" or "comprising" will be understood to imply the inclusion of stated elements but not the exclusion of any other elements and the name of a component doesn't set limits to the function of the component concerned.

FIG. 1 is a schematic diagram of cam phaser. In general, a cam phaser, a reference number of which is 10 in FIG. 2A to FIG. 6, comprises a rotor a reference number of which is 15 in FIG. 2A to FIG. 3C, a stator a reference number of which is 16 in FIG. 2A to FIG. 3C, and vanes. The stator may function as a cam phaser housing, too.

The cam phaser 10 may be fitted with a gear or a chain sprocket 11. The chain sprocket 11 transmits engine power by engaging with a chain driven by an engine crankshaft which is a driving shaft.

The cam phaser 10 is constituted or configured such that one of the rotor 15 and the stator 16 is driven with engine timing by being fixed to the chain sprocket 11 and the other of the rotor 15 and the stator 16 is rotatable relatively to the one fixed to the chain sprocket 11. The rotor 15 or the stator 16 may be driven and thereby the relative rotating motion may be generated by a hydraulic pressure type control apparatus or an electronic driving apparatus.

One of the rotor 15 and the stator 16 may be operatively connected to an outer shaft a reference number of which is 20 in FIG. 2A to FIG. 6, the other of the rotor 15 and the stator 16 may be operatively connected to an inner shaft a reference number of which is 25 in FIG. 2A to FIG. 5, and thereby the cam phaser 10 may be operatively connected to a control camshaft a reference number of which is 2 in FIG. 2A to FIG. 6. In this case, the control camshaft may be a camshaft-in-camshaft.

By this, a relative rotating motion can be generated between a first cam a reference number of which is 23 in FIG. 2A to FIG. 3C and a second cam a reference number of which is 24 in FIG. 2A to FIG. 3C and a variable valve timing method can be realized.

Figures 2A, 2B, 2C:
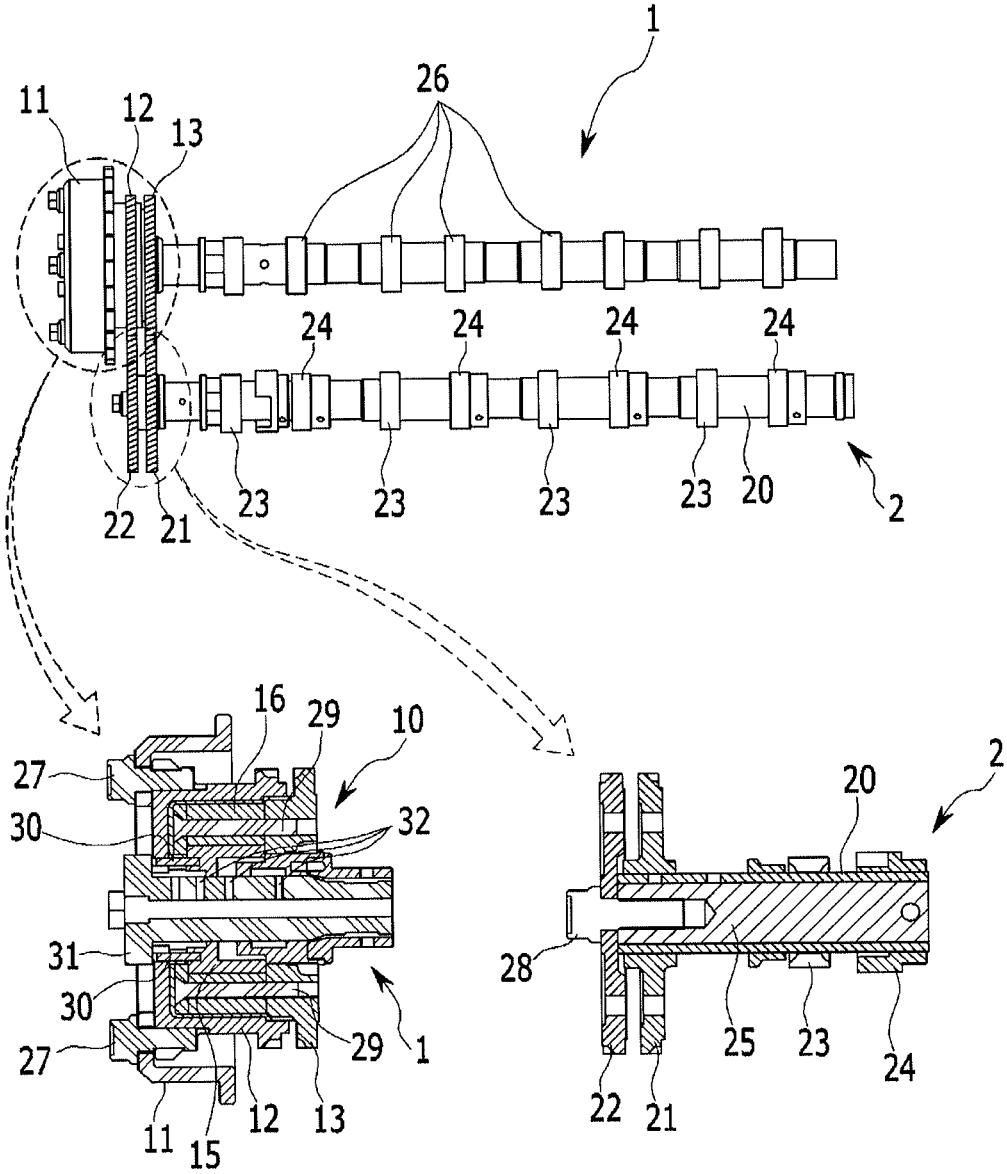
FIG. 2A is a drawing which shows a first exemplary valve train layout structure (phasing by an outer shaft) according to the present invention.
FIG. 2B is a partially enlarged view of FIG. 2A.
FIG. 2C is another partially enlarged view of FIG. 2A.

FIGS. 2A-2C are drawings which show a first exemplary valve train layout structure (phasing by an outer shaft) according to the present invention. Referring to FIGS. 2A-2C, a first exemplary valve train layout structure according to various embodiments of the present invention may comprise a non-control camshaft 1, a control camshaft 2, a cam phaser 10, and a chain sprocket 11.

The non-control camshaft 1 may be fixedly connected to the chain sprocket 11 rotating in line with engine timing and operates such that opening/closing timing of a valve connected to the non-control camshaft does not vary.

The control camshaft 2 is a camshaft-in-camshaft and comprises an outer shaft 20, a first cam 23 fixed to the outer shaft 20, an inner shaft 25 rotatably inserted into the outer shaft 20, and a second cam 24 fixed to the inner shaft 25 and rotatable on the outer shaft 20.

The control camshaft 2 can vary opening/closing timing of at least one of a valve activated by the first cam 23 and a valve activated by the second cam 24 by varying a phase between the first cam 23 and the second cam 24.

The cam phaser 10 comprises a rotor 15 and a stator 16. The rotor 15 and the stator 16 are rotatable relatively to each other, one of the rotor 15 and stator 16 is operatively connected to the outer shaft 20, and the other of the rotor 15 and stator 16 is operatively connected to the inner shaft 25.

Referring to FIGS. 2A-2C, the connections may include gears. That is, the cam phaser 10 is fixedly combined or coupled with the non-control camshaft 1, the rotor 15 is fitted with a first driving gear 12, and the stator 16 is fitted with a second driving gear 13. Referring to FIGS. 2A-2C, in some embodiments, the rotor 15 and the first driving gear 12 are fixedly combined or coupled by a fixing pin 30 in a rotating direction. Accordingly, the rotor 15 and the first driving gear 12 have a same phase in the rotating direction.

The first driving gear 12 and the second driving gear 13 engage respectively with a second driven gear 22 mounted on one side portion of the inner shaft 25 and a first driven gear 21 mounted on one side portion of the outer shaft 20. By the gears above, the rotor 15 is operatively connected to the inner shaft 25 and the stator 16 is operatively connected to the outer shaft 20.

The chain sprocket 11 is fixedly combined or coupled with the rotor 15 and the non-control camshaft 1 by a cam phaser bolt 31 and with the first driving gear 12 by a chain sprocket bolt 27. The chain sprocket 11 is driven by a chain and rotates in line with engine timing. Accordingly, the rotor 15, the non-control camshaft 1 and the first driving gear 12 are driven fixedly in the engine timing.

Hereinafter, referring to FIGS. 2A-2C, an operation principle will be explained, by which a first exemplary valve train layout structure according to various embodiments of the present invention varies the opening/closing timing of a valve operatively connected to the control camshaft 2.

The stator 16 is driven in line with the engine timing by the fixing pin 30 and at the same time installed such that the stator 16 is rotatable relatively to the rotor 15. Accordingly, the stator 16 rotates relatively to the rotor 15 by pressure of oil flowing inside through oil holes 32 formed at the cam phaser bolt 31, and thereby variance of the phase between the rotor 15 and the stator 16 is generated.

Because the rotor 15 is operatively connected to the inner shaft 25 by the engagement of the first driving gear 12 and the second driven gear 22, the inner shaft 25 is driven fixedly in the engine timing.

Accordingly, the outer shaft 20 is operatively connected to the stator 16 by the engagement of the second driving gear 13 and the first driven gear 21. As the stator 16 operates by a hydraulic pressure type control apparatus and the phase of the outer shaft 20 varies, the opening/closing timing of a valve operatively connected to the control camshaft 2 varies. That is, the varying method of valve timing is a method phasing by the outer shaft 20.

Meanwhile, as mentioned earlier, in various exemplary embodiments of the valve train being installed such that the rotor 15 is rotatable relatively to the stator 16, it is obvious that the varying method of valve timing can be a method phasing by the inner shaft 25 with the same or similar structure. Since the structure is the same or similar, detailed explanation will be omitted.

Figures 3A, 3B, 3C:
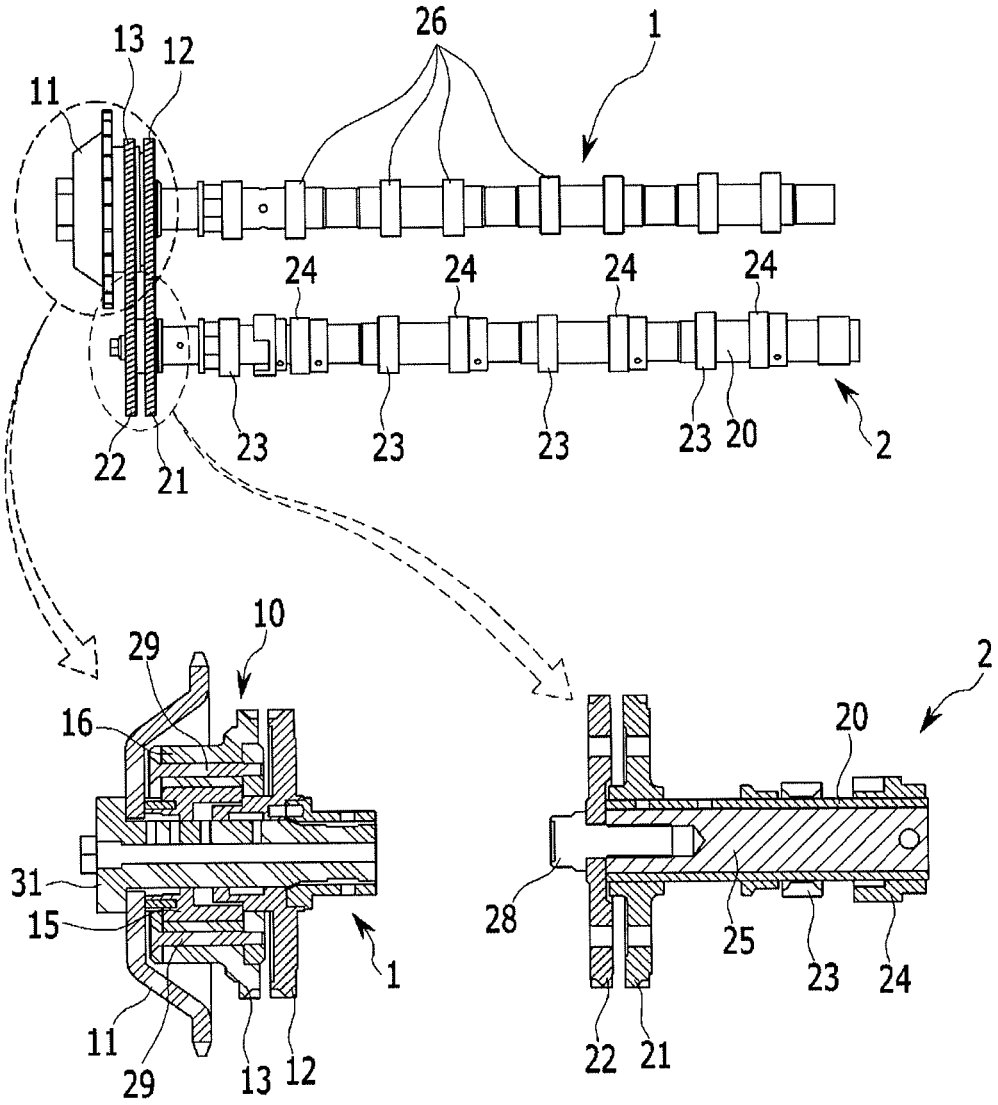
FIG. 3A is a drawing which shows a second exemplary valve train layout structure (phasing by an inner shaft) according to the present invention.
FIG. 3B is a partially enlarged view of FIG. 3A.
FIG. 3C is another partially enlarged view of FIG. 3A.

FIGS. 3A-3C are drawings which show a second exemplary valve train layout structure (phasing by an inner shaft) according to the present invention. In a second valve train layout structure, constituting elements are the same as in the first valve train layout structure according to the present invention.

However, the cam phaser 10 and the gears are constituted or configured such that the order of the first driving gear 12 and the second driving gear 13 positioned on one side portion of the non-control camshaft 1 is reversed. On account of a characteristic of a camshaft-in-camshaft, the order of the first driven gear 21 and the second driven gear 22 on the one side portion of the control camshaft 2 is the same as in the first valve train layout structure.

Hereinafter, referring to FIGS. 3A-3C, an operation principle will be explained, by which a second exemplary valve train layout structure according to various embodiments of the present invention varies the opening/closing timing of a valve operatively connected to the control camshaft 2.

The stator 16 is driven in line with the engine timing by the fixing pin 30 and at the same time installed such that the stator 16 is rotatable relatively to the rotor 15. Accordingly, the stator 16 rotates relatively to the rotor 15 by pressure of oil flowing inside through oil holes 32 formed at the cam phaser bolt 31, and thereby variance of the phase between the rotor 15 and the stator 16 is generated.

But, different than in the first valve train layout structure, the order of the first driving gear 12 and the second driving gear 13 is reversed. Because the rotor 15 is operatively connected to the outer shaft 20 by the engagement of the first driving gear 12 and the first driven gear 21, the outer shaft 20 is driven fixedly in the engine timing.

Accordingly, the inner shaft 20 is operatively connected to the stator 16 by the engagement of the second driving gear 13 and the second driven gear 22. As the stator 16 operates by a hydraulic pressure type control apparatus and the phase of the inner shaft 25 varies, the opening/closing timing of a valve operatively connected to the control camshaft 2 varies. That is, the varying method of valve timing is a method phasing by the inner shaft 25.

Meanwhile, as mentioned earlier, in various exemplary embodiments of the valve train being installed such that the rotor 15 is rotatable relatively to the stator 16, it is obvious that the varying method of valve timing can be a method phasing by the outer shaft 20 with the same or similar structure. Since the structure is the same or similar, detailed explanation will be omitted.

Figure 4:
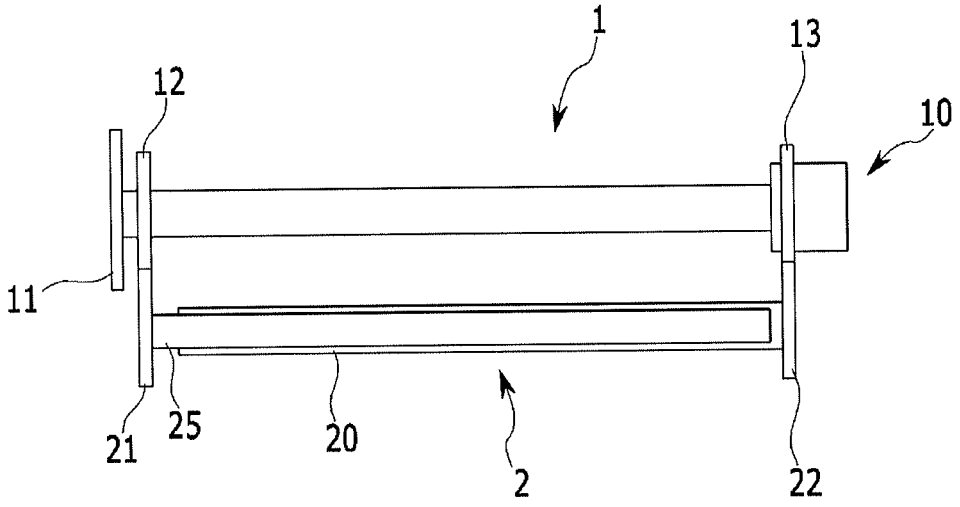
FIG. 4 is a schematic diagram which shows a third exemplary valve train layout structure (phasing by an outer shaft) according to the present invention.

FIG. 4 is a schematic diagram which shows a third exemplary valve train layout structure (phasing by an outer shaft) according to the present invention. Referring to FIG. 4, one side portion of a non-control camshaft 1 is fitted with a chain sprocket 11 and a first driving gear 12 and an opposite end of the non-control camshaft 1 is fitted with a cam phaser 10 equipped with a second driving gear 13.

An inner shaft 25 of a control camshaft 2 is fitted with a first driven gear 21 engaging with the first driving gear 12 and an outer shaft 20 is fitted with a second driven gear 22 engaging with the second driving gear 13. The first driving gear 12 and the non-control camshaft 1 are driven fixedly in the engine timing by the chain sprocket 11.

Because the first driven gear 21 engaging with the first driving gear 12 is driven in the engine timing and the second driven gear 22 engaging with the second driving gear 13 has the phase varied depending on variance of hydraulic pressure of the cam phaser 10, the phase of the outer shaft 20 and the opening/closing timing of a valve operatively connected to the control camshaft 2 varies. That is, the varying method of valve timing is a method phasing by the outer shaft 20.

Meanwhile, as mentioned earlier, in various exemplary embodiments of the valve train installed such that the rotor 15 is rotatable relatively to the stator 16, the train layout structure illustrated in FIG. 4 can be readily adjusted to change the way of relative motion of the rotor 15 and the stator 16 with the same or similar structure. For example, the train layout structure of valve timing illustrated in FIG. 4 can be readily adjusted such that the second driving gear 13 rotates in line not with the stator 16 but with the rotor 15. In this case, the varying method of valve timing is also a method phasing by the outer shaft 20, which is the same as in the situation above.

Figure 5:
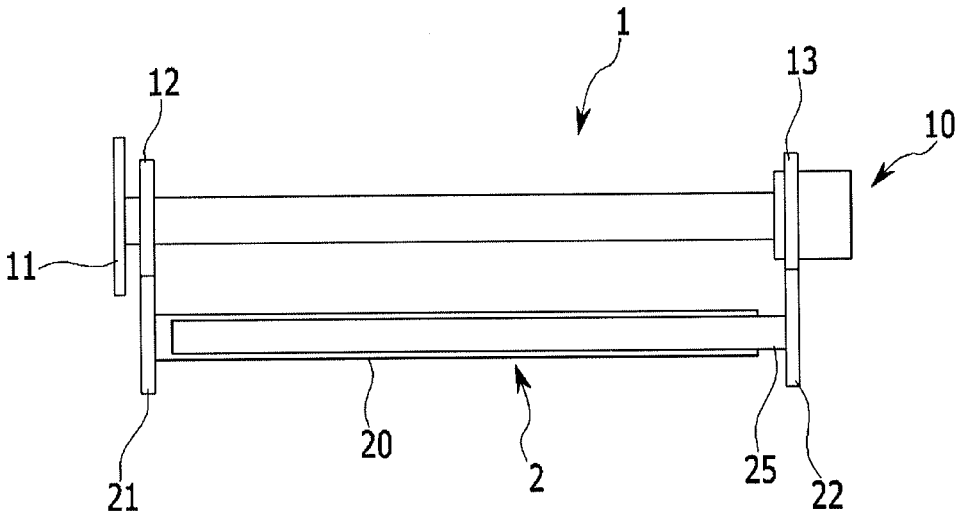
FIG. 5 is a schematic diagram which shows a fourth exemplary valve train layout structure (phasing by an inner shaft) according to the present invention.

FIG. 5 is a schematic diagram which shows a fourth exemplary valve train layout structure (phasing by an inner shaft) according to the present invention. Referring to FIG. 5, one side portion of a non-control camshaft 1 is fitted with a chain sprocket 11 and a first driving gear 12, an opposite end of the non-control camshaft 1 is fitted with a cam phaser 10 equipped with a second driving gear 13.

An outer shaft 20 of a control camshaft 2 is fitted with a first driven gear 21 engaging with the first driving gear 12 and an inner shaft 25 is fitted with a second driven gear 22 engaging with the second driving gear 13. The first driving gear 12 and the non-control camshaft 1 are driven fixedly in the engine timing by the chain sprocket 11.

Because the first driven gear 21 engaging with the first driving gear 12 is driven in the engine timing and the second driven gear 22 engaging with the second driving gear 13 has the phase varied depending on variance of hydraulic pressure of the cam phaser 10, the phase of the inner shaft 25 and the opening/closing timing of a valve operatively connected to the control camshaft 2 varies. That is, the varying method of valve timing is a method phasing by the inner shaft 25.

Meanwhile, as mentioned earlier, in various exemplary embodiments of the valve train installed such that the rotor 15 is rotatable relatively to the stator 16, the train layout structure of valve timing illustrated in FIG. 5 can be readily adjusted to change the way of relative motion of the rotor 15 and the stator 16 with the same or similar structure. For example, the train layout structure of valve timing illustrated in FIG. 5 can be readily adjusted such that the second driving gear 13 rotates in line not with the stator 16 but with the rotor 15. In this case, the varying method of valve timing is also a method phasing by the inner shaft 25, which is the same as in the situation above.

Figure 6:
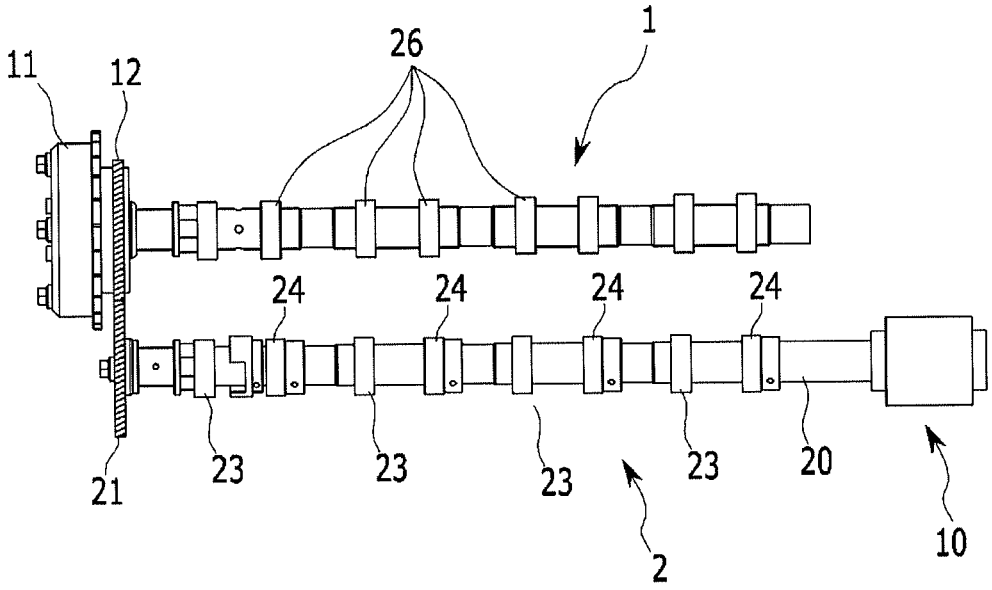
FIG. 6 is a drawing which shows a fifth exemplary valve train layout structure (phasing by an inner shaft) according to the present invention.

FIG. 6 is a drawing which shows a fifth exemplary valve train layout structure (phasing by an inner shaft) according to the present invention. Different than the valve train layout structures described above, in some embodiments, the valve train layout structure of the present invention has a rotor rotatable relatively to a stator, which will be explained.

Referring to FIG. 6, one side portion of a non-control camshaft 1 is fitted with a chain sprocket 11 and a first driving gear 12, an opposite end of a control camshaft 2 is fitted with a cam phaser 10, a rotor of the cam phaser 10 is operatively connected to an inner shaft of the control camshaft 2, and a stator of the cam phaser 10 is operatively connected to an outer shaft 20 of the control camshaft 2. The first driving gear 12 engages with a first driven gear 21 mounted on one side portion of the outer shaft 20. The first driving gear 12 and the non-control camshaft 1 are driven fixedly in the engine timing by the chain sprocket 11.

Because the first driven gear 21 engaging with the first driving gear 12 is driven in the engine timing and the inner shaft has the phase varied depending on variance of hydraulic pressure of the cam phaser 10, the opening/closing timing of a valve operatively connected to the control camshaft 2 varies. That is, the varying method of valve timing is a method phasing by the inner shaft 25.

Meanwhile, in some embodiments of the valve train installed such that the stator is rotatable relatively to the rotor, the first driving gear 12 engages with a first driven gear 21 on one side portion of the inner shaft 25, the first driven gear 21 is driven in the engine timing, and the outer shaft 20 has the phase varied depending on variance of hydraulic pressure of the cam phaser 10. Therefore, the varying method of valve timing is a method phasing by the outer shaft 20.

As stated in detail above, according to the present invention, in case a cam phaser cannot be directly installed on account of a layout or a vehicle package problem, the problem can be solved through change of a valve train layout structure. Without substantial change of an engine design or without a new engine development project, a remodeled engine can be utilized and thereby cost reduction become possible.

For convenience in explanation and accurate definition in the appended claims, the terms "left" or "right", "inner" or "outer", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A valve train layout structure comprising:

a non-control camshaft connected to a chain sprocket rotating in line with engine timing and adapted not to vary opening/closing timing of a valve;

a control camshaft including an outer shaft, a first cam fixed to the outer shaft, an inner shaft rotatably inserted in the outer shaft, and a second cam fixed to the inner shaft and the control camshaft adapted to vary opening/closing timing of at least one of a valve activated by the first cam and a valve activated by the second cam by varying a phase between the first cam and the second cam, the inner and outer shaft fitted with a pair of driven gears, respectively; and a cam phaser mounted on the non-control camshaft and including a rotor and a stator rotatable relatively to each other, the rotor and the stator being fitted with a pair of driving gears respectively, wherein one of the driving gears is gear-meshed with one of the driven gears which is fitted with the inner shaft and another of the driving gears is gear-meshed with another of the driven gears which is fitted with the outer shaft, wherein one of the rotor and the stator is operatively connected to the outer shaft and the other of the rotor and the stator is operatively connected to the inner shaft such that the cam phaser varies the phase between the first cam and the second cam.

2. The valve train layout structure of claim 1, wherein the rotor is driven in line with the engine timing and the stator is rotatable relatively to the rotor.

3. The valve train layout structure of claim 2, wherein one side portion of the outer shaft is fitted with a first driven gear and one side portion of the inner shaft is fitted with a second driven gear, and wherein the rotor is fitted with a first driving gear engaging with one of the first driven gear and the second driven gear, and the stator is fitted with a second driving gear engaging with the other of the first driven gear and the second driven gear.

4. The valve train layout structure of claim 3, wherein the rotor is fixedly connected with the chain sprocket, the first driving gear engages with the second driven gear, and the second driving gear engages with the first driven gear.

5. The valve train layout structure of claim 3, wherein the rotor is fixedly connected with the chain sprocket, the first driving gear engages with the first driven gear, and the second driving gear engages with the second driven gear.

6. The valve train layout structure of claim 2, wherein one side portion of the non-control camshaft is fitted with the chain sprocket and a first driving gear, and an opposite end of the non-control camshaft is fitted with the cam phaser equipped with a second driving gear, and wherein one of the inner shaft and the outer shaft is fitted with a first driven gear engaging with the first driving gear, and the other of the inner shaft and the outer shaft is fitted with a second driven gear engaging with the second driving gear.

7. The valve train layout structure of claim 6, wherein the first driven gear is mounted on a first side portion of the inner shaft and the second driven gear is mounted on a second side portion of the outer shaft.

8. The valve train layout structure of claim 6, wherein the second driven gear is mounted on a first side portion of the inner shaft and the first driven gear is mounted on a second side portion of the outer shaft.

9. The valve train layout structure of claim 1, wherein the stator is driven in line with the engine timing and the rotor is rotatable relatively to the stator.

10. The valve train layout structure of claim 9, wherein one side portion of the outer shaft is fitted with a first driven gear and one side portion of the inner shaft is fitted with a second driven gear, and wherein the rotor is fitted with a first driving gear engaging with one of the first driven gear and the second driven gear, and the stator is fitted with a second driving gear engaging with the other of the first driven gear and the second driven gear.

11. The valve train layout structure of claim 10, wherein the stator is fixedly connected with the chain sprocket, the first driving gear engages with the second driven gear, and the second driving gear engages with the first driven gear.

12. The valve train layout structure of claim 10, wherein the stator is fixedly connected with the chain sprocket, the first driving gear engages with the first driven gear, and the second driving gear engages with the second driven gear.

13. The valve train layout structure of claim 9, wherein one side portion of the non-control camshaft is fitted with the chain sprocket and a first driving gear, and the opposite end of the non-control camshaft is fitted with the cam phaser equipped with a second driving gear, and wherein one of the inner shaft and the outer shaft is fitted with a first driven gear engaging with the first driving gear, and the other of the inner shaft and the outer shaft is fitted with a second driven gear engaging with the second driving gear.

14. The valve train layout structure of claim 13, wherein the first driven gear is mounted on one side portion of the inner shaft and the second driven gear is mounted on the other side portion of the outer shaft.

15. The valve train layout structure of claim 13, wherein the second driven gear is mounted on one side portion of the inner shaft and the first driven gear is mounted on the other side portion of the outer shaft.

16. The valve train layout structure of claim 9, wherein one side portion of the non-control camshaft is fitted with the chain sprocket and a first driving gear, the opposite end of the control camshaft is fitted with the cam phaser, the rotor of the cam phaser is connected with the inner shaft, and the stator of the cam phaser is connected with the outer shaft, and wherein the first driving gear engages with a first driven gear mounted on one side portion of the outer shaft.

* * * * *